US009128410B2

(12) United States Patent
Suzuki et al.

(10) Patent No.: US 9,128,410 B2
(45) Date of Patent: Sep. 8, 2015

(54) WATERPROOF CONNECTOR

(71) Applicant: YAZAKI CORPORATION, Minato-ku, Tokyo (JP)

(72) Inventors: Etsurou Suzuki, Makinohara (JP); Yasuharu Kondo, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/191,509

(22) Filed: Feb. 27, 2014

(65) Prior Publication Data

US 2014/0179156 A1 Jun. 26, 2014

Related U.S. Application Data

(63) Continuation of application No. PCT/JP2012/004892, filed on Aug. 1, 2012.

(30) Foreign Application Priority Data

Aug. 30, 2011 (JP) ..... 2011-186878

(51) Int. Cl.
*G03G 15/08* (2006.01)
*H01R 13/52* (2006.01)
*G03G 21/18* (2006.01)

(52) U.S. Cl.
CPC ..... *G03G 15/0812* (2013.01); *G03G 15/0865* (2013.01); *G03G 21/1814* (2013.01); *H01R 13/5221* (2013.01)

(58) Field of Classification Search
CPC ..... H01R 13/5205; H01R 13/5208; H01R 13/5221
See application file for complete search history.

(56) References Cited

U.S. PATENT DOCUMENTS 5,836,788 A 11/1998 Torii
6,872,092 B2 * 3/2005 Oka ..... 439/587
6,913,486 B2 * 7/2005 Nagayasu et al. ..... 439/587
(Continued)

FOREIGN PATENT DOCUMENTS

JP H06-83407 U 11/1994
JP H09-73948 A 3/1997
(Continued)

OTHER PUBLICATIONS

Korean office action letter issued on Mar. 27, 2015 in the counterpart Korean patent application.
(Continued)

*Primary Examiner* — Ross Gushi
(74) *Attorney, Agent, or Firm* — Marvin A. Motsenbocker; Mots Law, PLLC

(57) ABSTRACT

A waterproof connector includes a housing on which an opening is formed, and in which terminals connected with electric wires are housed; a mat seal which is installed into the opening of the housing, and through which the wires are inserted; a mat seal holder which is engaged with the opening of the housing by an engagement structure to prevent the mat seal from dropping off from the housing, and through which the wires are inserted; and an engagement strengthening portion which is provided on one of the housing and the mat seal holder and configured to strengthen an engagement of the engagement structure. According to the waterproof connector, retention of the mat seal in the housing can be improved.

3 Claims, 6 Drawing Sheets

(56) References Cited

U.S. PATENT DOCUMENTS

| | | | | |
|---|---|---|---|---|
| 7,033,216 | B2 * | 4/2006 | Ito | 439/587 |
| 7,114,991 | B2 * | 10/2006 | Shiga et al. | 439/587 |
| 7,156,697 | B2 * | 1/2007 | Drescher | 439/587 |
| 7,156,698 | B2 * | 1/2007 | Yamashita | 439/587 |
| 7,270,556 | B2 * | 9/2007 | Mori et al. | 439/272 |
| 7,285,012 | B2 * | 10/2007 | Wada et al. | 439/587 |
| 7,351,102 | B2 * | 4/2008 | Cykon et al. | 439/587 |
| 7,371,115 | B1 * | 5/2008 | Hsieh et al. | 439/587 |
| 7,544,081 | B2 * | 6/2009 | Lim | 439/352 |
| 7,572,150 | B2 * | 8/2009 | Matsuoka | 439/626 |
| 7,744,411 | B2 * | 6/2010 | Casses et al. | 439/587 |
| 7,762,842 | B2 * | 7/2010 | Deubel et al. | 439/589 |
| 7,922,530 | B2 * | 4/2011 | Chazottes et al. | 439/587 |
| 8,177,584 | B2 * | 5/2012 | Matsuoka | 439/587 |
| 8,215,987 | B2 * | 7/2012 | Yoshioka et al. | 439/587 |
| 8,231,408 | B2 * | 7/2012 | Ebihara | 439/587 |
| 8,257,111 | B1 * | 9/2012 | Smutny et al. | 439/511 |
| 8,647,132 | B2 * | 2/2014 | Kuroda et al. | 439/271 |
| 8,662,910 | B2 * | 3/2014 | Ichio et al. | 439/206 |
| 8,721,373 | B2 * | 5/2014 | Suzuki et al. | 439/701 |
| 8,747,154 | B2 * | 6/2014 | Uchiyama | 439/587 |
| 2001/0016457 | A1 | 8/2001 | Taguchi et al. | |
| 2002/0076995 | A1 * | 6/2002 | Kurimoto et al. | 439/752 |
| 2005/0106916 | A1 * | 5/2005 | Nomura | 439/275 |
| 2008/0014795 | A1 * | 1/2008 | Lutsch et al. | 439/587 |
| 2008/0119079 | A1 * | 5/2008 | Suzuki et al. | 439/281 |
| 2011/0117780 | A1 * | 5/2011 | Ishida | 439/589 |
| 2014/0011400 | A1 * | 1/2014 | Shiga, Katsumi | 439/587 |
| 2014/0179156 | A1 * | 6/2014 | Suzuki et al. | 439/521 |
| 2014/0256169 | A1 * | 9/2014 | Suzuki et al. | 439/312 |
| 2014/0295708 | A1 * | 10/2014 | Omori et al. | 439/626 |
| 2015/0056846 | A1 * | 2/2015 | Kataoka et al. | 439/456 |
| 2015/0056859 | A1 * | 2/2015 | Higuchi et al. | 439/607.41 |

FOREIGN PATENT DOCUMENTS

| | | | |
|---|---|---|---|
| JP | 2001-237019 | A | 8/2001 |
| JP | 2004-039584 | A | 2/2004 |
| JP | 2007-299936 | A | 11/2007 |
| JP | 2008-004471 | A | 1/2008 |

OTHER PUBLICATIONS

Japanese office action letter issued on Mar. 24, 2015 in the counterpart Japanese patent application.

* cited by examiner

WATERPROOF CONNECTOR

CROSS-REFERENCE TO RELATED APPLICATIONS

The present application is a Continuation Application of PCT International Application No. PCT/JP2012/004892 (filed on Aug. 1, 2012), which is based upon and claims the benefit of priority from Japanese Patent Application No. 2011-186878 (filed on Aug. 30, 2011), the entire contents of which are incorporated herein with reference.

BACKGROUND OF THE INVENTION

1. Technical Field

The present invention relates to a waterproof connector.

2. Background Art

U.S. Pat. No. 5,836,788 (filed based on a priority of Japanese Patent Application No. H7-228167 [publication No. H9-73948]) discloses one of prior art waterproof connectors. The waterproof connector disclosed in the U.S. Pat. No. 5,836,788 includes a housing, a mat seal, and a terminal holder (mat seal holder). An opening is formed on the housing, and terminals connected with electric wires are housed in the housing. The wires are inserted through the mat seal, and the mat seal is installed into the opening of the housing to seal the housing. The wires are also inserted through the terminal holder, and the terminal holder is fixed at the opening of the housing by an engagement structure (retaining pawls and retaining holes) to prevent the terminal holder from dropping off from the housing.

In the above-explained waterproof connector, the retaining pawls are provided on the terminal holder, and the retaining holes are provided on the housing. The terminal holder is inserted into the housing until the retaining pawls and the retaining holes are engaged with each other. Then, the mat seal is held by being surrounded with a cover plate of the terminal holder and a projected plate and a support projection of the housing. As a result, the housing is sealed by the mat seal.

SUMMARY OF INVENTION

However, in the above-mentioned waterproof connector, the engagement between the retaining pawls and the retaining holes may loosen. If an external force applies to the connector via the wires, the looseness may cause disengagement of the terminal holder from the housing. In this case, the mat seal cannot be held tightly in the housing, so that sealing may become insufficient.

An object of the present invention provides a waterproof connector that can improve retention of a mat seal in a housing.

An aspect of the present invention provides a waterproof connector that includes a housing on which an opening is formed, and in which terminals connected with electric wires are housed; a mat seal which is installed into the opening of the housing, and through which the wires are inserted; a mat seal holder which is engaged with the opening of the housing by an engagement structure to prevent the mat seal from dropping off from the housing, and through which the wires are inserted; and an engagement strengthening portion which is provided on one of the housing and the mat seal holder and configured to strengthen an engagement of the engagement structure.

According to the aspect, the engagement strengthening portion is provided on the one of the housing and the mat seal holder, so that looseness of the engagement structure is prevented and thereby undesirable disengagement of the engagement structure due to an external force can be prevented. Therefore, undesirable disengagement of the mat seal holder from the housing is prevented and thereby retention of the mat seal in the housing can be improved.

Here, it is preferable that the engagement structure includes a first engagement portion provided on the mat seal holder and a second engagement portion provided on the housing, the first engagement portion has a first surface that faces an opposite direction to an engagement direction of the mat seal holder with the housing, the second engagement portion has a second surface that faces an opposite direction to a disengagement direction of the mat seal holder from the housing, and the engagement strengthening portion is formed as a biasing portion that biases another of the housing and the mat seal holder so as to bias the mat seal holder toward the disengagement direction.

According to this, the engagement strengthening portion is formed as the biasing portion that biases the other of the housing and the mat seal holder so as to bias the mat seal holder toward the disengagement direction, so that the engagement between the first and second surfaces (the first and second engagement portions) can be steadily engaged. Therefore, the looseness of the engagement structure is further prevented and thereby the retention of the mat seal in the housing can be improved effectively.

In addition, it is further preferable that the biasing portion is provided on the mat seal holder as a protrusion protruded toward the engagement direction.

According to this, the engagement of the engagement structure can be strengthen by a simple structure without extensive design changes in the mat seal holder.

DESCRIPTION OF EMBODIMENTS

Figure 1:
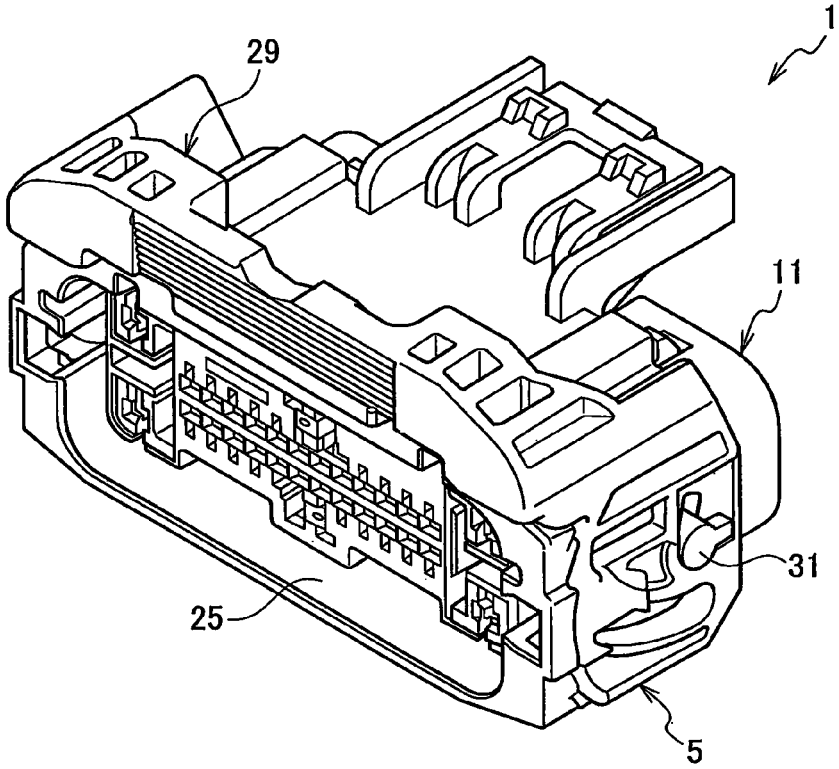
FIG. 1 is a perspective view of a waterproof connector according to an embodiment.

An embodiment of a waterproof connector 1 will be explained with reference to FIGS. 1 to 10.

As shown in FIGS. 1 to 4, the waterproof connector 1 includes a housing 5, a mat seal 7, and a mat seal holder 11. An opening 3 (see FIG. 10A) is formed on the housing 5, and terminals (not visible in FIG. 1) connected with electric wires (not shown in the drawings) are housed in the housing 5. The wires are inserted through the mat seal 7, and the mat seal 7 is installed into the opening 3 of the housing 5 to seal the housing 5. The wires are also inserted through the mat seal holder 11, and the mat seal holder 11 is fixed at the opening 3 of the housing 5 by a pair of engagement structures 9 (see FIG. 10C) in order to prevent the mat seal 7 from dropping off from the housing 5.

Figure 10A:
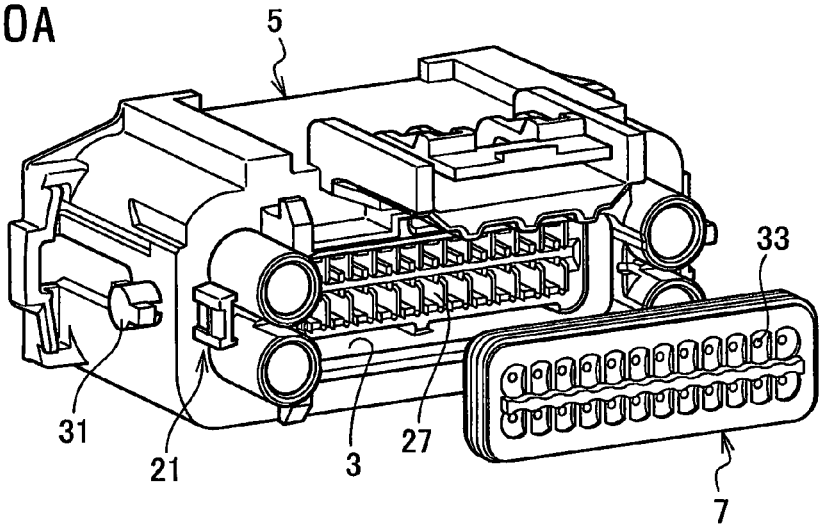
FIG. 10A is a perspective view showing a state where the mat seal is about to be installed in the housing in an assembling process of the waterproof connector.
Figure 10B:
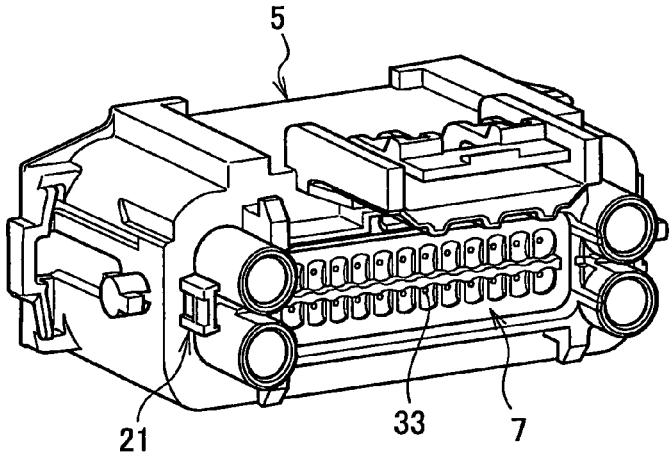
FIG. 10B is a perspective view showing a state where the mat seal is installed in the housing in the assembling process of the waterproof connector.
Figure 10C:
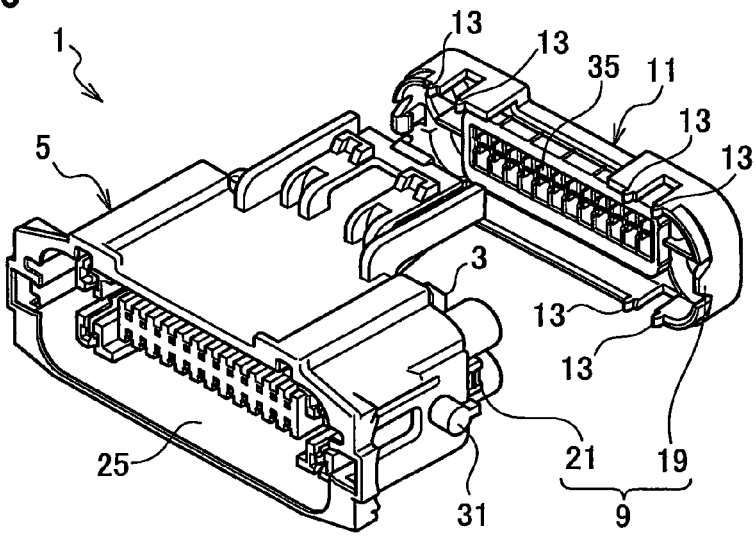
FIG. 10C is a perspective view showing a state where the mat seal holder is about to be engaged with the housing in the assembling process of the waterproof connector.

As shown in FIGS. 10C and 5, the pair of engagement structures 9 is provided on the housing 5 and the mat seal holder 11. Each of the engagement structures 9 includes a first engagement portion (engagement pawl) 19 provided on the mat seal holder 11 and a second engagement portion (engagement tab) 21 provided on the housing 5. Note that only one of the pair is visible in FIG. 10C. In addition, as shown in FIGS. 10C and 6, engagement strengthening portions 13 (biasing portions [protrusions] 23) are provided on the mat seal holder 11 to strengthening the engagement of the engagement structures 9.

Figure 5A:
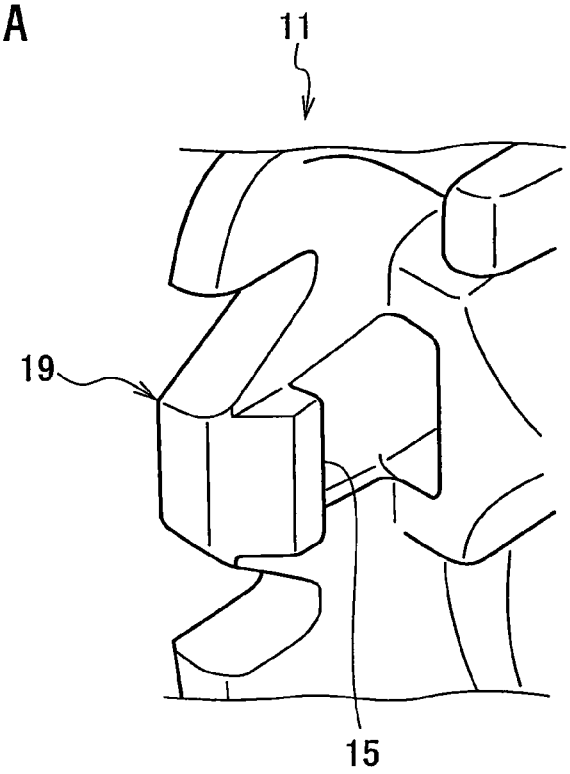
FIG. 5A is an enlarged perspective view showing a first engagement portion of an engagement structure in the waterproof connector.
Figure 5B:
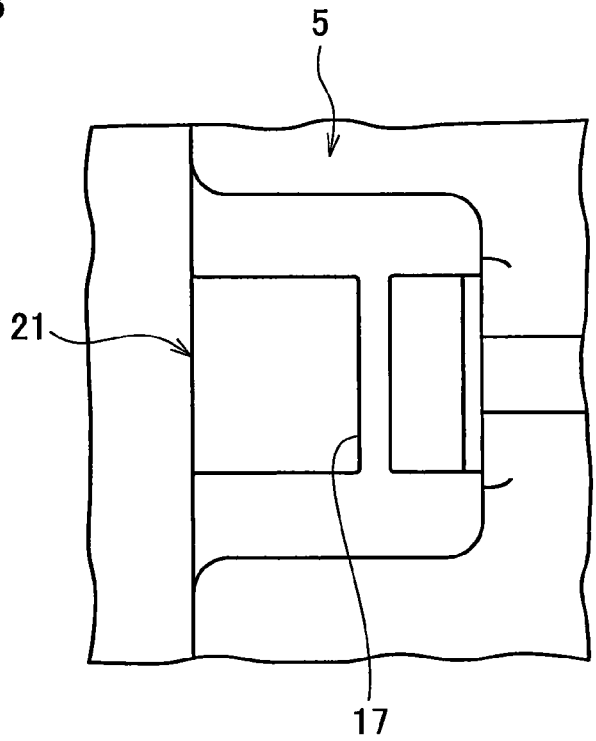
FIG. 5B is an enlarged perspective view showing a second engagement portion of an engagement structure in the waterproof connector.

As explained above, each of the engagement structures 9 includes the engagement pawl 19 on the mat seal holder 11 and the engagement tab 21 on the housing 5. As shown in FIG. 5A, the engagement pawl 19 on the mat seal holder 11 includes a first surface 15 that faces an opposite direction (see an arrow in FIG. 8) to an engagement direction of the mat seal holder 11 with the housing 5. As shown in FIG. 5B, the engagement tab 21 on the housing 5 includes a second surface 17 that faces an opposite direction to a disengagement direction (see an arrow in FIG. 8) of the mat seal holder 11 from the housing 5 (i.e. the engagement direction and the disengagement direction face opposite directions to each other).

Figure 6:
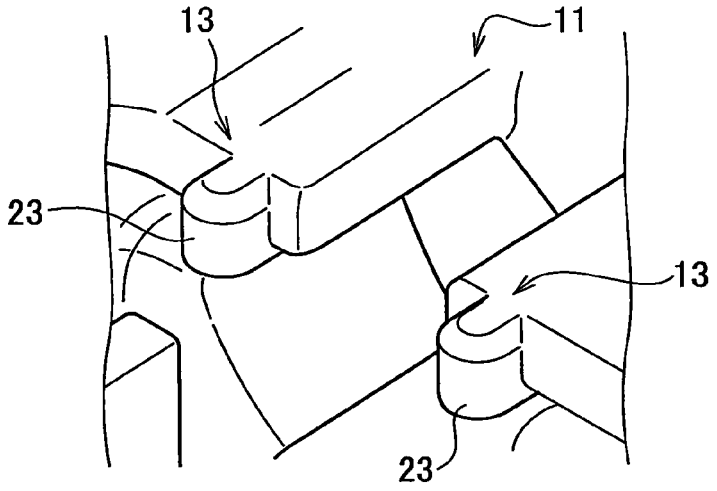
FIG. 6 is an enlarged perspective view showing engagement strengthening portions in the waterproof connector.
Figure 7:
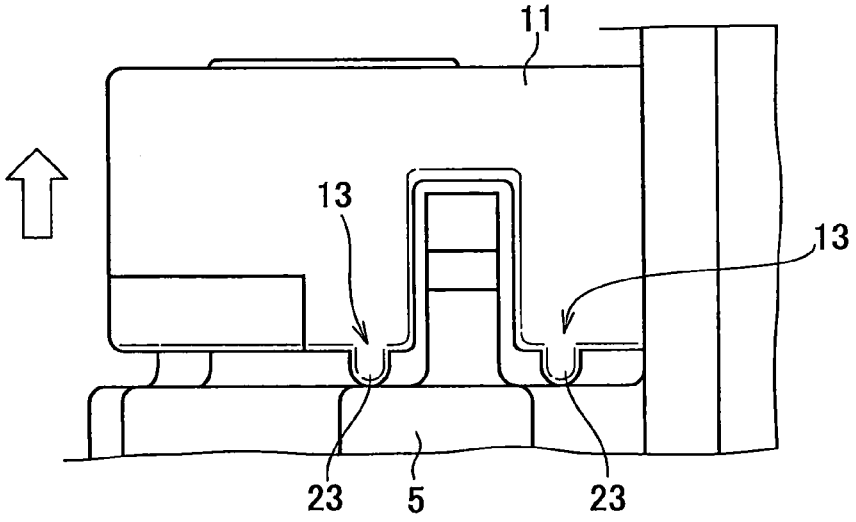
FIG. 7 is an enlarged plan view showing an assembled state of the waterproof connector where the housing and the engagement strengthening portions are contacted with each other.
Figure 8:
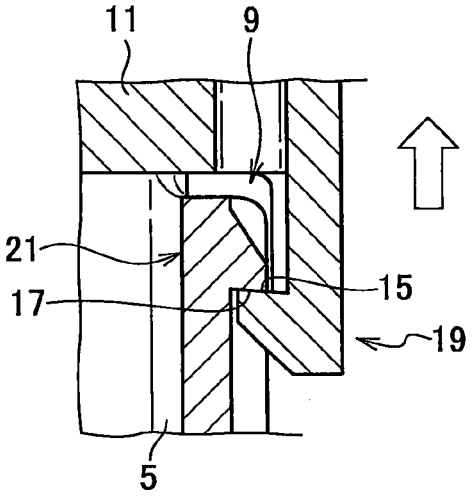
FIG. 8 is an enlarged cross-sectional view showing the engagement structure in the assembled state.

As shown in FIG. 6, each of the engagement strengthening portions 13 is formed as the biasing portion (biasing protrusion) 23. The biasing protrusion 23 on the mat seal holder 11 is a protrusion protruded toward the engagement direction of the mat seal holder 11 with the housing 5. Therefore, when the housing 5 and the mat seal holder 11 are engaged with each other, the biasing protrusion 23 biases the mat seal holder 11 toward the disengagement direction (see an arrow in FIG. 7) of the mat seal holder 11 from the housing 5. The engagement strengthening portions 13 (biasing protrusions 23) will be explained in detail later.

Figure 2:
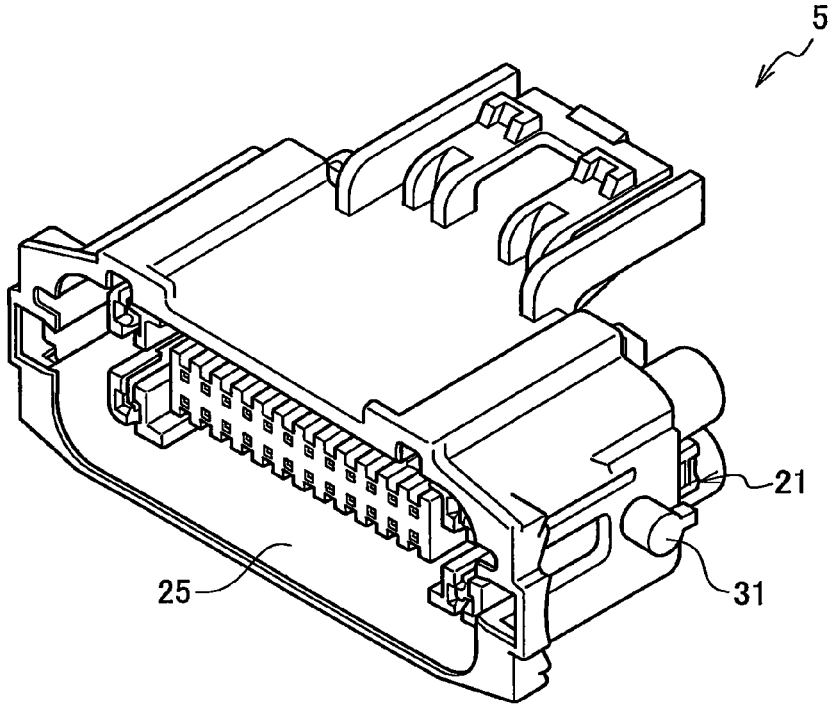
FIG. 2 is a perspective view of a housing in the waterproof connector.

As shown in FIGS. 2 and 10A, the housing 5 is formed to have a box-like shape, and includes a connection end 25 and terminal cavities 27. The connection end 25 is opened at one end of the housing 5, and another connector (not shown) is to be connected to the connection end 25. The above-explained opening 3 is opened another end of the housing 5. In addition, a lever 29 (see FIG. 1) is rotatably attached to support pivots 31 on the housing 5. The lever 29 is used for supporting connection of the other connector to the connection end 25.

The terminals are installed into the housing 5 through the opening 3. The installed terminals are held in the terminal cavities 27, respectively.

The terminal cavities 27 are aligned along a width direction of the housing 5, and arranged in two rows in a height direction of the housing 5. When the other connector is connected to the connection end 25 of the waterproof connector 1, terminals in the other connector are electrically connected with the terminals in the terminal cavities 27, respectively. The mat seal 7 is installed into the opening 3 of the housing 5 in order to seal off the housing 5.

Figure 3:
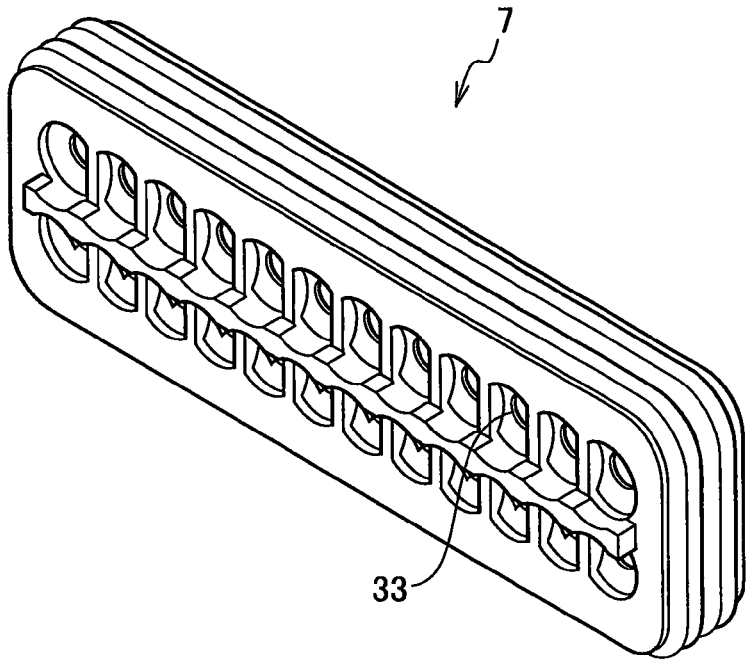
FIG. 3 is a perspective view of a mat seal in the waterproof connector.

The mat seal 7 shown in FIG. 3 is made of elastic material such as rubber, and its outer circumferential outline is formed to have an outline similar to an inner circumferential shape of the opening 3 of the housing 5. In addition, sealing holes 33 are formed on the mat seal 7, and the wires are inserted through the sealing holes 33, respectively. Naturally, the number of the sealing holes 33 is equal to that of the terminal cavities 27 of the housing 5. The outer circumferential outline of the mat seal 7 is made larger than the inner circumferential shape of the opening 3 of the housing 5. Therefore, when the mat seal 7 is inserted into the opening 3 (see FIGS. 10A and 10B), its outer circumferential outline is fit tightly to the inner circumference of the opening 3 to seal the housing 5. The mat seal 7 is prevented from dropping off from the housing 5 by the mat seal holder 11.

Figure 4:
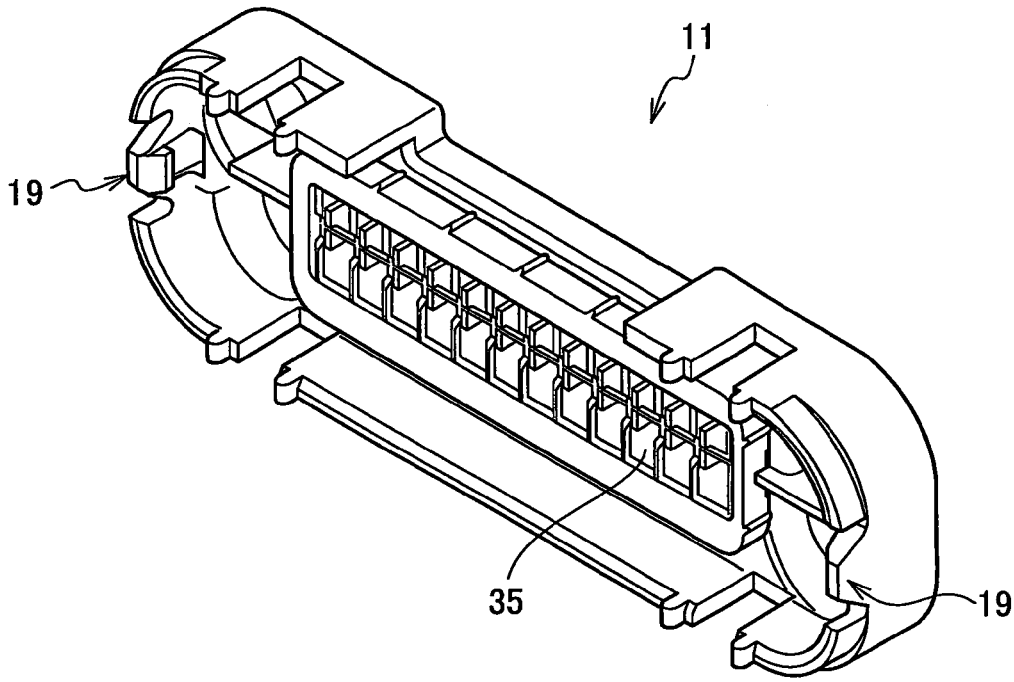
FIG. 4 is a perspective view of a mat seal holder in the waterproof connector.

The mat seal holder 11 shown in FIG. 4 is attached to the housing 5 so as to close the opening 3 (see FIG. 10C). In addition, insertion holes 35 are formed on the mat seal holder 11, and the wires are also inserted through the insertion holes 35, respectively. Naturally, the number of the insertion holes 35 is equal to that of the terminal cavities 27 of the housing 5 or the sealing holes 33 on the mat seal 7. The mat seal holder 11 is fixed with the housing 5 by the pair of engagement structures 9.

The engagement structures 9 are provided on both sides of the housing 5 and the mat seal holder 11, and each of the engagement structures 9 is configured of the engagement pawl 19 and the engagement tab 21 (see FIG. 10C). The engagement pawl 19 is formed as a barbed tab and can be bent elastically outward along a width direction of the housing 5 and the mat seal holder 11 (see FIGS. 4 and 5A). In addition, the engagement pawl 19 has the above-explained first surface 15 as an engagement surface. The first surface 15 is engaged with the second surface 17 of the engagement tab 21 (see FIG. 8).

The engagement tab 21 has a recess opened outward along the width direction (see FIGS. 2 and 5B). In addition, the engagement tab 21 has the above-explained second surface 17 as another engagement surface. The second surface 17 is a surface of one of sidewalls of the recess. The second surface 17 is engaged with the first surface 15 of the engagement pawl 19 (see FIG. 8). When the first and second surfaces 15 and 17 are engaged with each other, the mat seal holder 11 can be prevented from dropping off from the housing 5.

During engaging the mat seal holder 11 with the housing 5, the engagement pawl(s) 19 bends outward and runs over an end of the engagement tab(s) 21. When the pawl(s) of the engagement pawl(s) 19 reaches to the recess(es) of the engagement tab(s) 21, the engagement pawl(s) 19 bends back due to its elastic restoring force. As a result, the first and second surfaces 15 and 17 are engaged with each other, and thereby a movement of the mat seal holder 11 relative to the housing 5 is restricted. This engagement between the engagement pawl(s) 19 and the engagement tab(s) 21 (between the first and second surfaces 15 and 17) is strengthened by the engagement strengthening portions 13.

As explained above, each of the engagement strengthening portions 13 is formed as the biasing protrusion 23 provided on the mat seal holder 11, and protruded toward the housing 5 from an end surface of the mat seal holder 11. In other words, the biasing protrusion 23 is protruded toward an annular end surface around the opening 3 of the housing 5 (an opposite surface to the mat seal holder 11). When the mat seal holder 11 is engaged with the housing 5, the biasing protrusions 23 contact with the opposite surface of the housing 5, so that the mat seal holder 11 is biased toward a direction (see an arrow in FIG. 7) so as to disengage the mat seal holder 11 from the housing 5 due to the biasing protrusions 23.

Note that each protruded length of the biasing protrusions 23 is set to a length that does not impede the engagement between the engagement pawls 19 and the engagement tabs 21 (between the first and second surfaces 15 and 17). In other words, each protruded length of the biasing protrusions 23 is set to a length that does not preclude the engagement between the engagement pawls 19 and the engagement tabs 21 (between the first and second surfaces 15 and 17). Eight of the biasing protrusions 23 (engagement strengthening portions 13) are provided in total. As shown in FIGS. 10C and 4, four of the biasing protrusions 23 are aligned along the width direction on an upper portion of the mat seal holder 11. And remaining four of the biasing protrusions 23 are aligned along the width direction on a lower portion of the mat seal holder 11 (two of them are not visible in FIG. 10C).

Due to the contacts of the biasing protrusions 23 with the opposite surface of the housing 5 while the mat seal holder 11 is engaged with the housing 5, a biasing force applies to the mat seal holder 11 toward a direction (see the arrow in FIG. 7) so as to disengage the mat seal holder 11 from the housing 5. Therefore, the biasing force also applies to the engagement structures 9 (see an arrow in FIG. 8), so that the first and second surfaces 15 and 17 are steadily engaged with each other and thereby looseness of the engagement structures 9 can be prevented.

Figure 9:
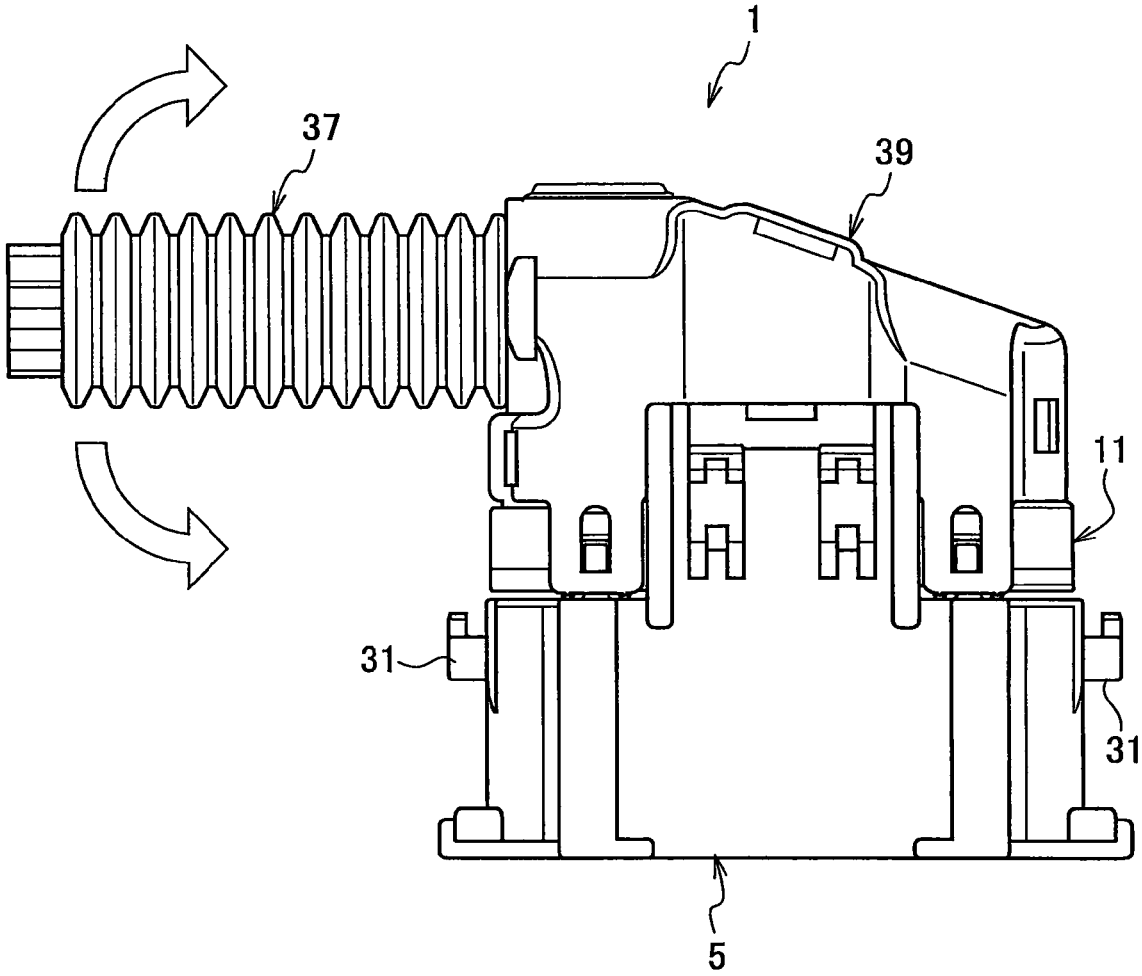
FIG. 9 is a plan view of the waterproof connector in the assembled state.

According to the above explained waterproof connector 1 in which the engagement of the engagement structures 9 is strengthen, even if an external force applies to a harness 37 (a bundle of the wires led out from the mat seal holder 11: see FIG. 9) so as to pull the mat seal holder 11, the looseness of the engagement structures 9 is prevented and thereby the mat seal holder 11 can be prevented from dropping off from the housing 5. Due to such an anti-looseness structures for the engagement structures 9 by the engagement strengthening portions 13, holding steadiness of the mat seal holder 11 by the housing 5 is made strengthen and thereby steadiness against an external force can be improved.

When assembling the waterproof connector 1, the mat seal 7 is installed into the opening 3 of the housing 5 at first. The mat seal 7 is set in the inside of the opening 3 so as to fit its outer circumferential outline tightly to the inner circumference of the opening 3. Then, the opening 3 is closed by the mat seal holder 11 so that the mat seal 7 is held between the housing 5 and the mat seal holder 11. The mat seal holder 11 is steadily engaged with the housing 5 by the engagement structures 9. In this manner, assembling of the waterproof connector 1 is completed.

According to the waterproof connector 1 according to the present embodiment, the engagement strengthening portions 13 are provided on the mat seal holder 11 in order to strengthen the engagement of the engagement structures 9, so that the looseness of the engagement structures 9 can be prevented by the engagement strengthening portions 13. Therefore, undesirable disengagement of the engagement structures 9 due to an external force can be prevented.

Since the waterproof connector 1 can prevent the mat seal holder 11 from dropping off from the housing 5, the holding steadiness of the mat seal 7 relative to the housing 5 can be improved.

In addition, the engagement strengthening portions 13 are formed as the biasing portions [protrusions] 23 that bias the mat seal holder 11 toward the disengagement direction (see the arrows in FIGS. 7 and 8) of the mat seal holder 11 from the housing 5. Since the biasing portions 23 bias the mat seal holder 11, the engagement of the first surface 15 on the engagement pawl 19 and the second surfaces 17 on the engagement tab 21 is made strengthen. Therefore, the looseness of the engagement structures 9 is prevented and thereby the mat seal holder 11 can be held steadily by the housing 5.

Further, the biasing portions 23 are formed so as to protrude toward the opposite surface of the housing 5, so that the engagement of the engagement structures 9 can be strengthen by a simple structure without extensive design changes in the mat seal holder 11.

Note that, although the engagement strengthening portions 13 are provided on the mat seal holder 11 in the waterproof connector 1 according to the present embodiment, an engagement strengthening portion(s) may be provided on the housing 5.

In addition, the engagement strengthening portions 13 are formed as the biasing portions 23 that strengthen the engagement of the first and second surfaces 15 and 17 of the engagement structures 9 in the waterproof connector 1 according to the present embodiment. However, the engagement strengthening portion(s) 13 may take another configuration suitable for a configuration of the engagement structure(s) 9.

Further, the engagement structure 9 may also take various configurations. For example, the engagement structure 9 may have a modified configuration in which an additional support portion is provided outside the engagement pawl (first engagement portion) 19 in order to enhancing a bend back force (holding force) of the engagement pawl (first engagement portion) 19. Alternatively, the engagement structure 9 may have another configuration in which the engagement structure is configured of a press-in rod and a press-in hole. Here, the rod and the hole may be provided further with an anti-pullout structure. For example of the anti-pullout structure, a circumferential convex rib may be formed on an outer circumferential surface of the rod, and a circumferential concave groove may be formed on an inner circumferential surface of the hole (or, a circumferential barbed rib on an outer circumferential surface of the rod, and a circumferential engagement groove on an inner circumferential surface of the hole).

Furthermore, the biasing portion(s) 23 is formed as a protrusion protruded toward the disengagement direction of the housing 5 from the mat seal holder 11 in the waterproof connector 1 according to the present embodiment. However, the biasing portion may be formed as an elastic member (e.g. a spring) for biasing the mat seal holder 11.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A waterproof connector comprising:

a housing having opposite sides in one of which a wire-terminal opening is formed, and containing terminal cavities for holding terminals connected with electric wires;

a mat seal dimensioned to fit tightly into the opening of the housing against an end surface around the wire-terminal opening of the housing, and perforated with electric-wire sealing holes;

a mat seal holder disengagably engagable with the housing in the wire-terminal opening thereof, along an end surface of the mat seal holder opposing the end surface around the wire-terminal opening of the housing, the mat seal holder perforated with electric-wire insertion holes;

an engagement structure constituted by engager portions on one of either the housing or the mat seal holder, and engaged portions on the other of either the housing or the mat seal holder, the engager portions engaging into the engaged portions in an engagement direction in which the mat seal holder is engaged into the housing; and biasing protrusions on one of either the end surface of the housing or the end surface of the mat seal holder, the biasing protrusions constituted and configured such as to abut against the other of either the end surface of the housing or the end surface of the mat seal holder, and impart force on the mat seal holder biasing it disengagement-ward, in a direction that is the opposite of the engagement direction.

2. The waterproof connector according to claim 1, wherein:

the engager portions have a first surface that faces in the direction that is the opposite of the engagement direction, and the engaged portions have a second surface that faces disengagement-ward.

3. The waterproof connector according to claim 2, wherein the biasing protrusions are of length that does not impede the first surface on the engager portions from engaging on the second surface of the engaged portions when the mat seal holder is engaged into the wire-terminal opening in the housing.

* * * * *